US005348561A

United States Patent [19]

Sexton et al.

[11] Patent Number: 5,348,561

[45] Date of Patent: Sep. 20, 1994

[54] FUEL OIL COMPOSITIONS

[75] Inventors: Michael D. Sexton, Didcot; Rosalind H. Strange, Bath, both of England

[73] Assignee: Exxon Chemical Patents Inc., Linden, N.J.

[21] Appl. No.: 53,936

[22] Filed: Apr. 26, 1993

Related U.S. Application Data

[63] Continuation of Ser. No. 486,959, Mar. 1, 1990, abandoned.

[51] Int. Cl.[5] ..... C10L 1/22

[52] U.S. Cl. ..... 44/422; 44/329; 44/333; 44/372; 44/408

[58] Field of Search ..... 44/422, 408

[56] References Cited

U.S. PATENT DOCUMENTS

| | | | |
|---|---|---|---|
| 1,973,676 | 9/1934 | Voorhees . | |
| 2,633,415 | 3/1953 | Chenicek . | |
| 2,867,515 | 1/1959 | Andress, Jr. . | |
| 2,900,788 | 8/1959 | Felberg et al. . | |
| 3,008,813 | 11/1961 | Siegel . | |
| 3,019,081 | 1/1962 | Doss et al. . | |
| 3,033,665 | 5/1962 | Gaston et al. . | |
| 3,102,797 | 9/1963 | Udelhofen . | |
| 3,129,699 | 4/1964 | Millikan . | |
| 3,158,647 | 11/1964 | Myers . | |
| 3,244,491 | 4/1966 | Marsh et al. | 44/408 |
| 3,256,074 | 6/1966 | Eckert . | |
| 3,265,474 | 8/1966 | Siegel . | |
| 3,346,353 | 10/1967 | Strickland et al. . | |
| 3,361,546 | 1/1968 | Raymond et al. . | |
| 3,387,954 | 6/1968 | Capowski et al. | 44/72 |
| 3,397,970 | 8/1968 | Strickland . | |
| 3,493,354 | 2/1970 | Jones | 44/57 |
| 3,778,371 | 12/1973 | Malec | 44/57 |
| 3,833,345 | 9/1974 | Tatsuke et al. . | |
| 3,880,613 | 4/1975 | Oswald et al. | 44/72 |
| 4,171,959 | 10/1979 | Vartanian . | |
| 4,261,703 | 4/1981 | Tack et al. | 44/62 |

FOREIGN PATENT DOCUMENTS

| | | |
|---|---|---|
| 293192 | 11/1988 | European Pat. Off. . |
| 1021525 | 2/1956 | Fed. Rep. of Germany . |
| 405330 | 7/1966 | Switzerland . |
| 803474 | 10/1958 | United Kingdom . |
| 973826 | 10/1964 | United Kingdom . |
| 995747 | 6/1965 | United Kingdom . |
| 1078497 | 8/1967 | United Kingdom . |
| 1199015 | 7/1970 | United Kingdom . |
| 1221647 | 2/1971 | United Kingdom . |
| 1392600 | 4/1975 | United Kingdom . |
| 1409019 | 10/1975 | United Kingdom . |
| 1432265 | 4/1976 | United Kingdom . |

OTHER PUBLICATIONS

Offenhauer, R. D. et al, Industrial and Engineering Chemistry, Aug. 1957, vol. 49, pp. 1265–1266.

*Primary Examiner*—Ellen M. McAvoy
*Attorney, Agent, or Firm*—V. T. White

[57] ABSTRACT

Sediment and color formation in distillate fuels are reduced by the addition of a quaternary ammonium compound comprising a cation in which the ratio of carbon atoms to quaternary nitrogen atoms is not more than 10:1 and an anion which is derived from an acid which is a carboxylic acid, carboxylic acid anhydride, phenol, sulphurized phenol or sulphonic acid.

17 Claims, No Drawings

FUEL OIL COMPOSITIONS

This is a continuation of application Ser. No. 486,959, filed Mar. 1, 1990, which is based on UK 89.04785,f. Mar. 2, 1989, now abandoned.

This invention relates to fuel oil compositions and more especially to fuel oil compositions containing cracked components which are stabilized against sediment formation and color development during storage. Cracked components are frequently included to give higher yields of diesel fuel and heating oil.

However, when diesel and heating oils containing cracked components are stored at ambient or elevated temperatures in air they become discolored and precipitate sludge or sediment.

It is clear that the problem of discoloration and sediment formation is exacerbated by the presence of cracked components in the fuel. This is demonstrated by the results in Table 1 which show the amount of sediment formed and the color change when various fuel blends are tested in the AMS 77.061 accelerated stability test. Published research (see, for example, Offenhauer et. al, Industrial and Engineering Chemistry, 1957, Volume 49, page 1265, and the Proceedings of the 2nd International Conference on the Long Term Stability of Liquid Fuels, San Antonio, Tex., published October 1986) suggests that discoloration and sediment result from the oxidation of sulphur and nitrogen compounds present in the fuel. The analysis of cracked components is consistent with this. The results in Table 2 show that cracked components contain significantly larger quantities of nitrogen and sulphur than straight distillates. Also, the addition of nitrogen and sulphur compounds to a stable straight distillate causes an increase in both sediment and color in the AMS 77.061 test (Table 3) with the worst result being obtained when both nitrogen and sulphur compounds are present in the fuel.

We have found that sediment and color formation in distillate fuels which are stored at ambient temperatures for long periods may be reduced by the addition of certain quaternary ammonium compounds.

There are several patents which disclose the use of quaternary ammonium compounds in fuel oils. Most of these patents disclose the use of quaternary ammonium compounds in which the sum total of carbon atoms in the cation exceeds 10. U.S. Pat. Nos. 3,008,813, 3,265,474, 3,397,970 and 3,346,353 all disclose the use of quaternary ammonium compounds containing the cation:

$$[R_2NMe_2]^{(+)}$$

where R is $C_{12}$ to $C_{14}$, as agents for improving the water tolerance of hydrocarbon oils.

U.S. Pat. Nos. 3,033,665 and 3,158,647 both disclose the use of quaternary ammonium compounds containing the cation:

$$[R_2NR'_2]^{(+)}$$

where R is $C_8$ to $C_{22}$ and R' is $C_1$ to $C_4$, as additives for producing a non-stalling gasoline and as fuel oil stabilisers.

U.S. Pat. No. 3,493,354 discloses the use of quaternary ammonium compounds containing the cation:

$$[R_4N]^{(+)}$$

in which the sum total of carbon atoms is at least 12, as part of a package to prevent smoke.

U.K. Patent No. 973,826 discloses the use of quaternary ammonium nitrites containing the cation:

$$[R_2NR'_2]^{(+)}$$

where R is $C_{12}$ to $C_{22}$ and R' is $C_1$ to $C_{10}$, as a fuel additive to be used in conjunction with an amine.

U.K. Patent No. 1,078,497 discloses the use of quaternary ammonium compounds containing the cation:

$$[R_2NR'_2]^{+)}$$

where R $C_6$ to $C_{22}$ and R' is $C_1$ to $C_5$.

U.K. Patent No. 1,392,600 discloses the use as antiwear additives of quaternary ammonium phosphates in which the cation contains at least 10 (and preferably more) carbon atoms.

U.K. Patent No. 1,409,019 discloses the use of quaternary ammonium compounds containing the cation:

$$[RN(CH_3)_3]^{(+)}$$

R is $C_8$ to $C_{40}$, as additives to improve the water tolerance of hydrocarbon liquids.

Three patents disclose the use of quaternary ammonium compounds in which the total number of carbons atoms in the cation is less than 10. Two of the patents, U.K. Patents Nos. 1,199,015 and 1,221,647, disclose use of quaternary ammonium phosphates and thiophosphates. However phosphorus "poisons" transition metal catalysts such as are commonly used as particulate traps in e.g. diesel engines. The third patent, U.K. Patent No. 1,432,265, describes quaternary ammonium compounds to be used in combination with a sulphone polymer as an antistatic additive.

The present invention provides a fuel composition comprising a fuel oil obtained by the cracking of heavy oil and a quaternary ammonium compound which is soluble in the fuel and which comprises a hydrocarbyl cation in which the ratio of carbon atoms to quaternary nitrogen atoms is not more than 10:1 and an anion which is derived from an acid which is a carboxylic acid, carboxylic acid arthydride, a phenol, a sulphurized phenol or a sulphonic acid. The hydrocarbyl group or groups optionally carries or carry a tertiary amino nitrogen atom or atoms but is or are otherwise unsubstituted.

Advantageously, the quaternary ammonium compound contains 1 to 4 quaternary nitrogen atoms, and not more than 10 carbon atoms.

The quaternary ammonium compounds are effective fuel stabilizers in the absence of any other additive. Furthermore, the quaternary ammonium compounds are more effective as fuel stabilizers than quaternary ammonium compounds in which the ratio of carbon atoms to quatermary nitrogen atoms in the cation exceeds 10.

Examples of suitable compounds are 1) Quaternary ammonium compounds in which the structure of the cation is:

$$[R^1R^2R^3R^4N]+$$

in which $R^1$, $R^2$, $R^3$, $R^4$ are alkyl cycloalkyl, alkenyl, cycloalkenyl, aryl, alkaryl or aralkyl groups such that the sum total of carbon atoms in the cation does not exceed 10.

Examples of such cations include tetramethylammonium, ethyltrimethylammonium, n-propyltrimethylammonium, iso-propyltrimethylammonium, n-butyltrimethylammonium, pentyltrimethylammonium, hexyltrimethylammonium, heptyltrimethylammonium, phenyltrimethylammonium, o-tolyltrimethylammonium, m-tolyltrimethylammonium, p-tolyltrimethylammonium, benzyltrimethylammonium, diethyldimethylammonium, di-n-propyldimethylammonium and di-n-buty ldimethylammonium. 2) Quaternary ammonium compounds in which the structure of the cation is:

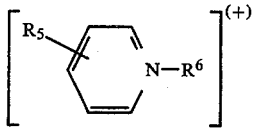

where $R^5$ and $R^6$ are alkyl, cycloalkyl, alkenyl, or cycloalkenyl and may be the same or different but are such that the total number of carbon atoms in the cation does not exceed 10.

Examples of such cations include methylpyridinium, ethylpyridinium, methyl-2-picolinium, methyl-3-picolinium and methyl-4-picolinium.

3) Quaternary ammonium compounds in which the structure of the cation is:

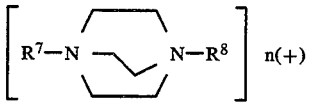

where $R^7$ is alkyl, cycloalkyl, alkenyl, cycloalkenyl where $R^8$ is nothing, when n=1, or alkyl, cycloalkyl, alkenyl or cycloalkenyl, when n=2, such that the ratio of carbon atoms in the cation to quaternary nitrogen atoms does not exceed 10:1.

Examples of such cations are the cations in which $R^7$=methyl, $R^8$ is absent and n=1 and in which $R^7=R^8$=methyl, and n=2.

4) Quaternary ammonium compounds in which the structure of the cation is:

$$[R^9R^{10}R^{11}R^{12}N_4(CH_2)_6]^{m(+)}$$

where $R^9$ is alkyl, cycloalkyl, alkenyl, cycloalkenyl where $R^{10}$, $R^{11}$, $R^{12}$ can be nothing, or alkyl, cycloalkyl, alkenyl, cycloalkenyl such that ratio of carbon atoms in the cation to quaternary nitrogen atoms does not exceed 10:1 m is 1 to 4, the value of m being increased from unity by one for each of $R^{10}$, $R^{11}$, $R^{12}$ having a meaning other than zero.

Examples of such cations are:

$$[(CH_3)_pN_4(CH_2)_6]^{p(+)}$$

where p is 1, 2, 3 or 4.

It will be understood that in compounds containing two or more quaternary nitrogen compounds the linkages between them will also be hydrocarbyl groups, i.e., the cation consists of quaternary nitrogen, carbon and hydrogen atoms, optionally substituted by tertiary amino nitrogen atoms.

Cations in groups (3) and (4) when $R^8$, or one or more of $R^{10}$, $R^{11}$, $R^{12}$, represent zero are examples of hydrocarbyl groups carrying tertiary amino nitrogen atoms.

The acid which is used to form the anion may be a carboxylic acid, carboxylic acid anhydride, phenol, sulphurized phenol or sulphonic acid.

The carboxylic acid may be e.g.:

i) An acid of the formula $$R^{13}—COOH$$

where $R^{13}$ is hydrogen, alkyl, cycloalkyl, alkenyl, cycloalkenyl, alkaryl, aralkyl, or aryl. Examples of such acids include formic acid, acetic acid, propionic acid, burytic acid, valetic acid, palnitic acid, stearic acid, cyclohexanecarboxylic acid, 2-methylcyclohexanecarboxylic acid, 4-methylcyclohexane carboxylic acid, oleic acid, linoleic acid, linolenic acid, cyclohex-2-eneoic acid, benzoic acid, 2-methylbenzoic acid, 3-methylbenzoic acid, 4-methylbenzoic acid, salicylic acid, 2-hydroxy-4-metehylbenzoic acid, 2-hydroxy-4-ethylsalicylic acid, p-hydroxybenzoic acid, 3,5-di-tert-butyl-4-hydroxybenzoic acid, o-aminobenzoic acid, p-aminobenzoic acid, o-methoxybenzoic acid and p-methoxybenzoic acid.

A dicarboxylic acid of the formula $$HOOC—(CH_2)_n—COOH$$

where n is zero or an integer, including e.g. oxalic acid, malonic acid, succinic acid, glutaric acid, adipic acid, pimelic acid and suberic acid. Also included are acids of the formula $$HOOC—(CH_2)_x—\overset{\overset{R^{13}}{|}}{CH}—(CH_2)_y—COOH$$

where x is zero or an integer, y is zero or an integer and x and y may be equal or different and $R^{13}$ is defined as in (i). Examples of such acids include the alkyl or alkenyl succinic acids, 2-methylbutanedioic acid, 2-ethylpentanedioic acid, 2-n-dodecylbutanedioic acid, 2-n-dodecenylbutanedioic acid, 2-phenylbutanedioic acid, and 2-(p-methylphenyl)butanedioic acid. Also included are polysubstituted alkyl dicarbcxylic acids wherein other $R^{13}$ groups as described above may be substituted on the alkyl chain. These other groups may be substituted on the same carbon atom or different atoms. Such examples include 2,2-dimethylbutanedioic acid: 2,3-dimethylbutanedioic acid; 2,3,4-trimethylpentanedioic acid; 2,2,3-trimethylpentanedioic acid; and 2-ethyl-3-methylbutanedioic acid.

The dicarboxylic acids also include acids of the formula:

$$HOOC—(C_rH_{2r-2})COOH$$

where r is an integer of 2 or more. Examples include maleic acid, fumaric acid, pent-2-enedioic acid, hex-2enedioic acid; hex-3-enedioic acid, 5-methylhex-2-enedioic acid: 2,3-di-methylpent-2-enedioic acid; 2-methylbut-2-enedioic acid: 2-dodecylbut-2-enedioic acid; and 2-polyisobutylbut-2-enedioic acid.

The dicarboxyilic acids also include aromatic dicarboxylic acids e.g. phthalic acid, isophthalic acid, terephthalic acid and substituted phthalic acids of the formula:

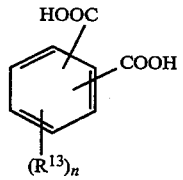

where $R^{13}$ is defined as in (i) and n=1, 2, 3 or 4 and when n>1 then the $R^{13}$ groups may be the same or different. Examples of such acids include 3-methylbenzene-1,2-dicarboxylic acid; 4-phenylbenzene-1,3-dicarboxylic acid; 2-(1-propenyl)benzene-1,4-dicarboxylic acid, and 3,4-dimethylbenzene-1,2-dicarboxylic acid.

The carboxylic acid anhydrides include the anhydrides that may be derived from the carboxylic acids described above. Also included are the anhydrides that may be derived from a mixture of any of the carboxylic acids described above. Specific examples include acetic anhydride, propionic anhydride, benzoic anhydride, maleic anhydride, succinic anhydride, dodecylsuccinic anhydride, dodecenylsuccinic anhydride, an optionally substituted polyisobutylenesuccinic anhydride, advantageously one having a molecular weight of between 500 and 2000 daltons, phthalic anhydride and 4-methylphthalic anhydride.

The phenols from which the anion of the quaternary ammonium compound may be derived are of many different types. Examples of suitable phenols include:

(i) Phenols of the formula:

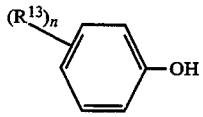

where n=1, 2, 3, 4 or 5, where $R^{13}$ is defined above and when n>1 then the substituents may be the same or different. The hydrocarbon group(s) may be bonded to the benzene ring by a keto or thio-keto group. Alternatively the hydrocarbon group(s) may be bonded through an oxygen, sulphur or nitrogen atom. Examples of such phenols include o-cresol: m-cresol; p-cresol; 2,3-dimethylphenol; 2,4-dimethylphenol; 2,3,4-trimethylphenol; 3-ethyl-2,4-dimethylphenol; 2,3,4,5-tetramethylphenol; 4-ethyl-2,3,5,6-tetranethylphenol; 2-ethylphenol; 3-ethylphenol; 4-ethylphenyl; 2-n-propylphenol: 2-isopropylphenol; 4-n-butylphenol; 4-isobutylphenol; 4-sec-butylphenol; 4-t-butylphenol; 4-nonylphenol; 2-dodecylphenol; 4-dodecylphenol: 4-octadecylphenol; 2-cyclohexylphenol; 4-cyclohexylphenol; 2-allylphenol; 4-allylphenol; 2-hydroxydipheny 1; 4-hydroxydiphenol; 4-methyl-4'-hydroxydiphenyl; o-methoxyphenol; p-methoxyphenol; p-phenoxyphenol; 2-hydroxydiphenylsulphide; 4-hydroxydiphenylsulphide; 4-hydroxyphenylmethylsulphide; and 4-hydroxyphenyldimethylamine. Also included are alkyl phenols where the alkyl group is obtained by polymerization of a low molecular weight olefin e.g. polypropylphenol or polyisobutylphenol.

Also included are phenols of the formula:

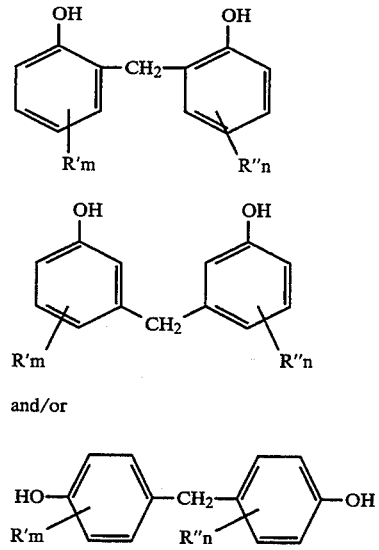

where R' and R'' which may be the same or different are as defined above for $R^{13}$ and m and n are integers. Examples of such phenols include 2,2'-dihydroxy-5,5'-dimethyldiphenylmethane; 5,5'-dihydroxy-2,2'-dimethyldiphenylmethane; 4,4'-dihydroxy-2,2'-dimethyldimethyldiphenylmethane; 2,2'-dihydroxy-5,5'-dinonyldiphenylmethane: 2,2'-dihydroxy-5,5'-didodecylphenylmethane and 2,2',4,4'-tetra-t-butyl-3,3'-dihydroxydiphenylmethane.

Also included are sulphurized phenols of the formula:

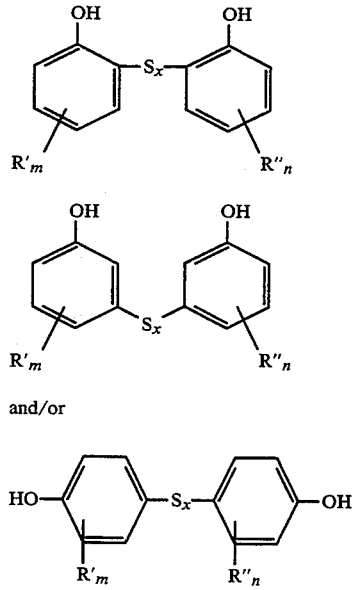

where R' and R'' which may be the same or different are as defined above, and m and n are integers and x is 1,2,3 or 4. Examples of such phenols include:

2,2'-dihydroxy-5,5'dimethyldiphenylsulphide;
5,5'-dihydroxy-2,2'-di-t-butyldiphenyldisulphide;
4,4'-dihydroxy-3,3'-di-t-butyldiphenylsulphide;
2,2'-dihydroxy-5,5'-dinonyldiphenyldisulphide; 2,2'-dihydroxy-5,5'-didodecyldiphenyldisulphide; 2,2'-dihydroxy-5,5'-didodecyldiphenyltrisulphide; and 2,2'-dihydroxy-5,5'-didodecyldiphenyl tetrasulphide.

The sulphonic acids from which the anion of the quaternary ammonium salt can be derived include alkyl and aryl sulphonic acids which have a total of 1–200 carbon atoms per molecule although the preferred range is 1–80 atoms per molecule. Included in this description are aryl sulphonic acids of the formula:

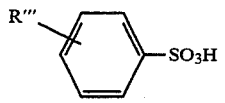

where n=1, 2, 3, 4, 5 and when n>1 the substituents may be the same or different, and R''' may represent $R^{13}$ as defined above.

The hydrocarbon group(s) may be bonded to the benzene ring through a carbonyl group or the thio-keto group. Alternatively the hydrocarbon group(s) may be bonded to the benzene ring through a sulphur, oxygen or nitrogen atom. Thus examples of sulphonic acids that may be used include: benzene sulphonic acid; o-toluenesulphonic acid, m-toluenesulphonic acid; p-toluene-sulphonic acid; 2,3-dimethylbenzenesulphonic acid;
2,4-dimethylbenzenesulphonic acid;
2,3,4-trimethylbenzenesulphonic acid;
4-ethyl-2,3-dimethylbenzenesulphonic acid;
4-ethylbenzenesulphonic acid;
4-n-propylbenzenesulphonic acid;
4-n-butylbenzenesulphonic acid;
4-isobutylbenzenesulphonic acid;
4-sec-butylbenzenesulphonic acid;
4-t-butylbenzenesulphonic acid;
4-nonylbenzenesulphonic acid;
2-dodecylbenzenesulphonic acid; 4-dodecylbenzenesulphonic acid: 4-cyclohexylbenzenesulphonic acid;
2-cyclohexylbenzenesulphonic acid;
2-allylbenzenesulphonic acid;
2-phenylbenzenesulphonic acid;
4(4'methylphenyl)benzenesulphonic acid;
4-methylmercaptobenzenesulphonic acid; 2-methoxybenzene sulphonic acid: 4-phenoxybenzenesulphonic acid;
4-methylaminobenzenesulphonic acid;
2-dimethylaminobenzenesulphonic acid; and
2-phenylaminobenzenesulphonic acid. Also included are sulphonic acids of the type listed above where R'' is derived from the polymerization of a low molecular weight olefin e.g. polypropylbenzenesulphonic acid and polyisobutylenebenzenesulphonic acid.

Also included are sulphonic acids of the formula:

$$R—SO_3H$$

where R is alkyl, cycloalkyl, alkenyl or cycloalkenyl. Examples of such sulphonic acids that may be used include methylsulphonic acid; ethylsulphonic acid; n-propylsulphonic acid: n-butylsulphonic acid; isobutylsulphonic acid; sec-butylsulphonic acid; t-butylsulphonic; nonylsulphonic acid; dodecylsulphonic acid: polypropylsulphonic acid; polyisobutylsulphonic acid; cyclohexylsulphonic acid: and 4-methylcyclohexylsulphonic acid.

Some of the quaternary ammonium salts which may be employed according to the present invention are commercially available. It is preferred to use one of these compounds. Alternatively the quaternary ammonium compounds may be synthesized in any suitable manner. The quaternary ammonium compounds may be prepared by known processes. Two methods are preferred for the synthesis of compounds such as quaternary ammonium sulphonates, sulphurized phenates and carboxylates.

In the first method a quaternary ammonium hydroxide is prepared by reacting, for example, a quaternary ammonium chloride with a strong base (for example sodium hydroxide) in an alcohol (for example methanol).

$$R_4N^{(+)}X^{(-)}+NaOH \rightarrow R_4N^{(+)}OH^{(-)}+NaX$$

After removing the metal halide by filtration, the solution of quaternary ammonium hydroxide is mixed with the acid in a suitable solvent and allowed to react:

$$R_4N(+)OH^{(-)}+HA \rightarrow R_4N(+)A(-)+H_2O$$

The rate of reaction may be increased by raising the reaction temperature above ambient. Once the reaction is complete the solvents and water are removed by distillation.

In the second method the organic acid is reacted with a metal oxide or hydroxide to form the metal salt:

$$HA+NaOH \rightarrow NaA+H_2O$$

If the reaction is done in a suitable solvent (for example, heptane or toluene) the water formed during the reaction may be removed by refluxing the solvent and using a Dean and Stark trap. Once all the water has been removed the solution of the metal salt is treated with a quaternary ammonium halide:

$$NaA+[R_4N]^{(+)}X^{(-)}[R_4N]^{(+)}A^{(-)}+NaX$$

The metal halide is removed by filtration, the solvent is removed by distillation. Alternatively, the solvent can be removed by distillation and the metal halide filtered from the final product.

Preferably the fuel composition comprises 5 to 1000 ppm, more preferably 10 to 500 ppm, and most preferably 20 to 200 ppm of quaternary ammonium compound based on parts of the fuel.

The cracked component in the fuel oil which leads to the undesirable color formation and sediment is generally obtained by cracking of heavy oil and may be fuel oil in which the main constituent is a fraction otained from a residual oil.

Typical methods available for the thermal cracking are visbreaking and delayed coking. Alternatively the fuels may be obtained by catalytic cracking, the principal methods being moving-bed cracking and fluidized-bed cracking. After cracking, the distillate oil is extracted by normal or vacuum distillation, the boiling point of the distillate oil obtained usually being 60°–500° C. Compositions composed entirely of this fuel or fuels which are mixtures of the cracked fraction and normal distillates may be used in the present invention.

The present invention accordingly provides a fuel composition comprising a distillate fraction and a cracked fraction and a quaternary ammonium compound soluble in the composition, the quaternary ammonium compound having a cation in which the substituent on the or each quaternary nitrogen is a hydrocarbyl group optionally bearing a tertiary amino nitrogen atom, and in which cation the ratio of carbon atoms to quaternary nitrogen atoms is at most 10:1, the anion being derived from a carboxylic acid or anhydride, a phenol, a sulphurized phenol or a sulphonic acid. The invention also provides the use of such a quaternary ammonium compound in inhibiting sediment and color formation in a fuel oil composition, especially one containing a component obtained by the cracking of heavy oil.

The proportion by weight of direct-distillation fraction and cracked fraction in a fuel oil composition which is a mixture can vary considerably, but is usually 1:0.03–1:2 and preferably 1:0.05–1:1. Typically the content of cracked fraction is usually 5–97%, and preferably 10–50%, based on the weight of the composition.

The fuel oil compositions of the present invention may contain other additives such as antioxidants, anticorrosion agents, fluidity improvers, agents absorbing ultraviolet radiation, detergents, dispersants and cetane improvers in small amounts (for example, usually less than 2% based on the weight of the composition).

The present invention is illustrated by the following examples:

EXAMPLE 1

Synthesis of Tetramethylammonium Dodecylphenate

A solution of sodium hydroxide (10 g; 0.25 moles) in methanol (100 mls) was added slowly, under nitrogen, to a stirred solution of tetramethylammonium bromide (38.5 g; 0.25 moles) in methanol (200 mls). When the addition was complete the solution was stirred for a further 30 minutes.

The sodium bromide was filtered off and the solution of the tetramethylammonium hydroxide added directly to a solution of dodecylphenol (65.5 g; 0.25 moles) in toluene (200 mls). The reaction mixture was heated to reflux for 1 hour and then the solvents were removed by heating to 150° C. under vacuum.

Stanco 150 (83.8 g), a mineral oil base stock (Exxon), was added to the product which was then filtered through Dicalite 4200 (diatomaceous earth).

TBN=122 mg KOH/g

TABLE 1 Shows the effect of blending different amounts of a straight distillate with an unhydrofined catalytically cracked gas oil on sediment and color in the AMS 77.061 accelerated stability test.

TABLE 2 Shows typical nitrogen and sulphur levels for straight run distillates and unhydrofined catalytically cracked gas oils.

TABLE 3 Shows the effect of doping a stable fuel with compounds containing nitrogen and sulphur.

TABLE 4 Shows AMS 77.061 test results on fuels treated with quaternary ammonium compounds in accordance with the present invention. From a comparison of the results for the treated fuels with the results for the untreated fuel, it is clear that the compounds of this invention give good control of color and sediment.

TABLE 1

| Fuel 3* wt % | Fuel 4** (*) | Sediment (mg/100 ml) | Δ Colour[a] |
|---|---|---|---|
| 100 | 0 | (0.14 ± 0.09) | ≃0.5, <0.5, <0.5 |
| 80 | 20 | (0.61 ± 0.13) | ≃1.0, 1.0, 1.0, 1.0 |
| 60 | 40 | (1.12 ± 0.10) | ≃1.0, ≃1.0, ≃1.0, ≃1 |
| 40 | 60 | (1.80 ± 0.04) | ~2.0, ~2.0 |
| 20 | 80 | (2.10 ± 0.10) | ~2.0, ~2.0 |

TABLE 1-continued

| Fuel 3* wt % | Fuel 4** (*) | Sediment (mg/100 ml) | Δ Colour[a] |
|---|---|---|---|
| 0 | 100 | 2.90 | ~6.0 |

*Straight distillate
**Unhydrofined catalytically cracked gas oil (CCGO)
[a]Colour Change (ASTM D1500 test)

TABLE 2

The Nitrogen and Sulphur Contents of Various Fuels

| Type of Fuel | Nitrogen (ppm) | Sulphur (%) |
|---|---|---|
| Unhydrofined CCGO | 695 | 1.11 |
| " | 650 | 1.70 |
| Straight distillate | 50 | 0.24 |
| " | 70 | 0.25 |
| " | 97 | 0.23 |
| " | 128 | 0.24 |

TABLE 3

The Effect of Doping with Dimethyl Pyrrole (DMP) and a Sulphonic Acid (SA) on the Stability of a Straight Distillate Fuel in the AMS 77.061 Test

| DMP (ppm)[a] | SA (ppm)[b] | Sediment (mg/100 ml) | Colour Before | Colour After |
|---|---|---|---|---|
| NIL | NIL | 0.06, 0.10 | <0.5 | <1.0 |
| NIL | 50 | 0.02, 0.00 | <0.5 | <1.5 |
| | | | <0.5 | <1.5 |
| 50 | NIL | 0.76, 0.59 | <0.5 | <1.0 |
| | | | <0.5 | <1.0 |
| 50 | 50 | 1.06, 1.01 | <1.5 | <3.0 |
| | | | <1.5 | <3.0 |

[a]2,5-dimethylpyrrole
[b]a commercially available alkyl-aryl sulphonic acid having a SAN of approximately 80 mg KOH/g of acid

TABLE

The Effect of Short Chain Quaternary Ammonium compounds in the AMS 77.061 Test

| CATION | ANION | SEDIMENT[a] | Δ COLOUR |
|---|---|---|---|
| NONE | NONE | (1.18 ± 0.20)[b] | ≃1.0 |
| $(CH_3)_4N$ | PIBSATE | (0.05 ± 0.06)[c] | ≃1.0, ≃1.0 |
| $(CH_3)_4N$ | DDP[d] | (0.16 ± 0.00)[c] | ≃0.5, ≃0.5 |
| $(CH_3)_4N$ | NPS[e] | (0.00 ± 0.00)[c] | ≃0.5, ≃0.5 |

[a]mgs/100 mls of fuel
[b](mean ± standard deviation) of 14 tests
[c](mean ± standard deviation) of 2 tests
[d]dodecylphenol
[e]nonylphenol sulphide
*Fuel is 80% straight distillate and 20% unhydrofined catalytically cracked gas oil
**Additive used at 100 ppm

We claim:

1. A fuel composition comprising a fuel oil obtained by the cracking of heavy oil and a fuel-soluble quaternary ammonium compound having a cation and an anion, said cation being selected from the group consisting of unsubstituted hydrocarbyl cations and tertiary amino nitrogen-bearing hydrocarbyl cations, said cation having a ratio of carbon atoms to quaternary nitrogen atoms of at most 10:1, said anion being selected from the group consisting of carboxylic acids, carboxylic acid anhydrides, phenols, sulphurized phenols, and sulphonic acids.

2. A fuel composition according to claim 1, which contains up to four quaternary nitrogen atoms.

3. A fuel composition according to claim 1, in which the cation is of the formula:

$$[R^1R^2R^3R^4N]^+$$

in which $R^1$, $R^2$, $R^3$, and $R^4$, which may be the same or different, are each alkyl, cycloalkyl, alkenyl, cycloalkenyl, aryl, aralkyl or alkaryl such that the number of carbon atoms in the cation does not exceed 10.

4. A composition according to claim 3, in which the cation is tetramethylammonium.

5. A composition according to claim 1, in which the cation is of the formula:

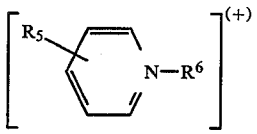

in which $R^5$ and $R^6$ which may be the same or different are each alkyl, cycloalkyl, alkenyl, or cycloalkenyl such that the number of carbon atoms in the cation does not exceed 10.

6. A composition according to claim 1, in which the cation is of the formula:

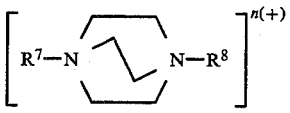

in which $R^7$ is alkyl, cycloalkyl, alkenyl or cycloalkenyl; $R^8$ is nothing in which case n is 1 or alkyl, cycloalkyl, alkenyl, or cycloalkenyl in which case n is 2, such that the ratio of carbon atoms to quaternary nitrogen atoms in the cation does not exceed 10.

7. A composition according to claim 1, in which the cation is of the formula:

$$[R^9R^{10}R^{11}R^{12}N_4(CH_2)_6]m(+)$$

in which $R^9$ is alkyl, cycloalkyl, alkenyl or cycloalkenyl; $R^{10}$, $R^{11}$ or $R^{12}$ which may be the same or different are each nothing, alkyl, cycloalkyl, alkenyl or cycloalkenyl, such that the ratio of carbon atoms to quaternary nitrogen atoms in the cation does not exceed 10; and m is an integer of 1 to 4, the value of m increasing from unity by one for each of $R^{10}$, $R^{11}$, and $R^{12}$ that represents a substituent.

8. A composition according to claim 7, in which the cation is N-methylhexamethylenetetrammonium or N,N'N'',N'''-tetramethylhexamethylenetetrammonium.

9. A composition according to claim 1 in which the anion of the quaternary ammonium compound is derived from a carboxylic acid.

10. A composition according to claim 1, in which the anion of the quaternary ammonium compound is derived from a carboxylic acid anhydride.

11. A composition according to claim 10, in which the anhydride is polyisobutylene succinic anhydride.

12. A composition according to claim 1, in which the anion of the quaternary ammonium compound is derived from a sulphurized phenol.

13. A composition according go claim 12, wherein the phenol is a sulphide containing up to 6 sulphur atoms selected from the group consisting of dihydroxy nonyl phenyl sulphides containing up to 4 nonyl groups and dihydroxy dodecyl phenyl sulphides containing up to 4 dodecyl groups.

14. A composition according to claim 1, wherein the anion of the quaternary ammonium compound is derived from a sulphonic acid.

15. A composition as defined in claim 1 in which the fuel oil comprises a direct-distillation fraction and cracked fraction, the cracked fraction comprising 5 to 97% by weight of the composition.

16. A composition as defined in claim 1 which comprises from 5 to 1000 ppm of the quaternary ammonium compound.

17. A method of inhibiting sediment color formation in a fuel comprising adding to the fuel and effective amount of a quaternary ammonium compound having a cation and an anion, said cation being selected from the group consisting of unsubstituted hydrocarbyl cations and tertiary amino nitrogen-bearing hydrocarbon cation, said cation having a ratio of carbon atoms to quaternary nitrogen atoms of at most 10:1, said anions being selected from the group consisting of carboxylic acid, carboxylic acid anhydride, phenols, sulfurized phenols, and sulfonic acids.

* * * * *